US006772971B1

(12) United States Patent
Becker et al.

(10) Patent No.: US 6,772,971 B1
(45) Date of Patent: Aug. 10, 2004

(54) SHREDDER

(76) Inventors: Udo Becker, Ludwig Richter Strasse 33, D-58706 Menden (DE); Igor Plahuta, Ritterhausstrasse 74, D-58708 Menden (DE)

( * ) Notice: Subject to any disclaimer, the term of this patent is extended or adjusted under 35 U.S.C. 154(b) by 0 days.

(21) Appl. No.: 09/711,268

(22) Filed: Nov. 13, 2000

(30) Foreign Application Priority Data

Nov. 13, 1999 (DE) ..... 299 19 968 U

(51) Int. Cl.[7] ..... B02C 18/16
(52) U.S. Cl. ..... 241/236; 241/285.2
(58) Field of Search ..... 241/243, 236, 241/235, 242, 285.2, 285.3

(56) References Cited

U.S. PATENT DOCUMENTS 5,395,057 A * 3/1995 Williams et al. ..... 241/36

FOREIGN PATENT DOCUMENTS

DE 4328687 A1 3/1995
EP 0667187 B1 8/1995
WO WO89/01364 2/1989

* cited by examiner

*Primary Examiner*—Mark Rosenbaum
(74) *Attorney, Agent, or Firm*—Flanagan & Flanagan; John R. Flanagan

(57) ABSTRACT

A shredder includes a cutting unit frame and a cutting shaft rotatably supported in the cutting unit frame and carrying a multiplicity of cutting disks, rotatable with the cutting shaft for shredding an item in cooperation with a further tool. The cutting unit frame has two opposing side parts extending parallel to the cutting shaft and two fronting parts extending transversely to the side parts and the cutting shaft. Each fronting part has upper and lower fronting part elements attached to one another and extending between and separately attached to the side parts and internally capturing one of two bearings therebetween such that the bearings rotatably mount the cutting shaft in the cutting unit frame and are removable with the cutting shaft upon removal of only the upper fronting part elements from the cutting unit frame without bringing the cutting unit frame out of adjustment.

7 Claims, 4 Drawing Sheets

Fig. 2
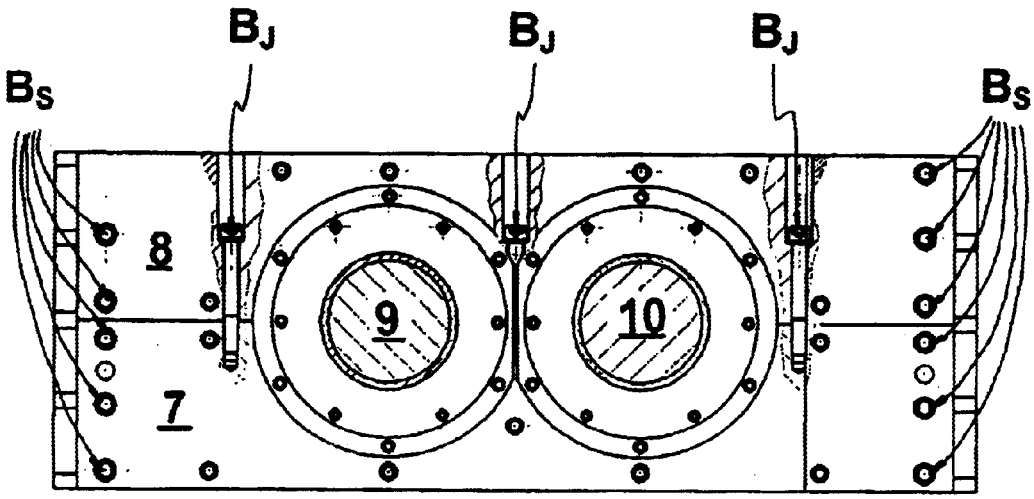
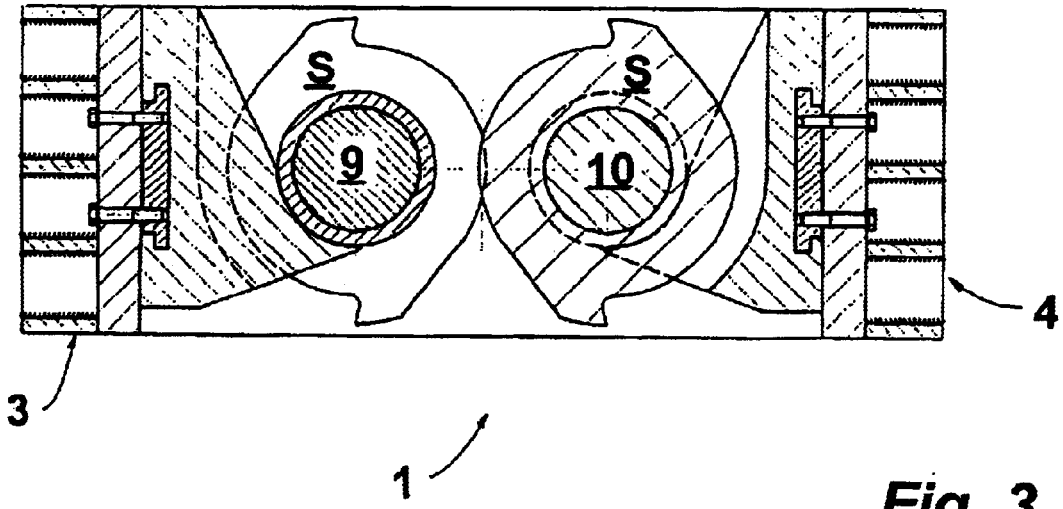
Fig. 3

SHREDDER

BACKGROUND OF THE INVENTION

The invention relates to a shredder which has a cutting unit frame and at least one motor-driven cutting shaft, rotatable supported in the cutting unit frame and carrying a multiplicity of cutting disks being rotatable with the shaft for shredding an item in cooperation with a further tool, the cutting unit frame including two opposing side parts extending parallel to the cutting shaft and two fronting parts each having respective upper and lower fronting part elements attached to one another and extending between and separately attached to the side parts and internally capturing one of a pair of bearings therebetween such that the bearings rotatably mount opposite ends of the shaft in the cutting unit frame and are removable with the shaft upon removal of only the upper fronting part element of each of the fronting parts.

Such shredders are frequently employed for recycling raw materials, wherein a multiplicity of differing products are shredded with such shredders, such as for example sheet metal parts, tires or also refrigerators, to name only a few. Such prior known shredder comprises a highly stable, distortion-free cutting unit frame, in whose fronting faces are supported at least one cutting shaft, driven, for example, by an electric motor. The one cutting shaft carries a multiplicity of cutting disks, which most often carry a multiplicity of cutting heads. The cutting disks are disposed such that they are spaced apart from one another and cooperate with a further tool, such as a stationary stripper or a second cutting shaft with cutting disks rotating counter to the one cutting shaft. A cut gap provided between the cutting disks or between one cutting disk and the stripper can only be a few tenths of a millimeter in order to obtain the desired cutting result. To ensure the correct rotation of the cutting shafts without the oppositely rotating cutting disks impairing each other, the cutting unit frame is layed out correspondingly stable and distortion-free such that even when shredding very hard or tough items, no distortion occurs on the cutting unit frame, which could change the cut gap between the cutting disks.

In a prior known shredder the two cutting shafts driven in the opposite direction are supported in the two opposing fronting parts. The fronting parts themselves are structured so as to be divided in two and formed by a lower fronting part element and an upper fronting part element. This division is provided in order for the cutting shaft to be lifted out of the cutting unit frame by dismounting the upper fronting part element. The fronting part elements themselves are secured between the end regions of the two opposing side parts. The attachment of the fronting part elements on the side parts takes place with attachment bolts which penetrate through the side parts and engage laterally the narrow sides of the fronting part elements. In this prior known shredder the cutting unit frame is formed when the side parts are bolted with all four fronting part elements. Apart from other means, with the attachment bolts, inter alia also by staying the side elements with one another, a necessary adjustment and setting-up of the cutting unit frame takes place in order to be able to ensure the correct travel of the cutting disks by setting up the cut gap correspondingly.

Due to their wear, the cutting disks must be replaced at periodic time intervals. In order to keep the time during which such shredder is not used during a replacement of the cutting disks as short as feasible, in this prior known shredder the entire cutting shaft is removed from the cutting unit frame and replaced by another with new cutting disks. For this purpose the attachment bolts of the two fronting part elements must be unscrewed and those of the upper fronting part element must be taken out completely in order to be able to remove this from the cutting unit frame. However, this causes the cutting unit frame to be brought out of adjustment. Even if a replacement of a cutting shaft by a new one can be carried out in this shredder in a short time, the disadvantage becomes manifest that with each new installation of a cutting shaft, the cutting unit frame must be set up anew and must be readjusted. This may require several days.

From EP 0 667 187 B1 is known a further shredder, in which the cutting unit frame is comprised of two side parts and two integrated fronting parts. The bearings of the two cutting shafts are disposed outside of the cutting unit frame. The bearings are structured in two parts such that after the upper bearing plate has been removed, the cutting shaft can be lifted out of the bearing. The two fronting parts of the cutting unit frame have oblong cutouts through which the cutting shafts are guided under sealing. Each of the top-side mounting of the seals is realized through an aperture plate secured outside on the fronting part. Due to the integrated implementation of the fronting parts, when dismounting the cutting shafts, in this prior known shredder, the cutting unit frame does not need to be brought out of adjustment. Consequently, the replacement of the cutting shafts can take place significantly faster compared to the previously described prior art.

However, of disadvantage in the shredder according to EP 0 667 187 B1 is that bearings disposed outside of the cutting unit frame—so-called external bearings—are provided for the bearing of the cutting shafts. In particular when mounting such a shredder therefore not only the cutting unit frame must be adjusted but additionally the two external bearings, which causes considerable additional expenses for the mounting. Moreover, a replacement of the cutting shafts is complex and expensive due to the numerous connections which must be detached. Building on this discussed prior art, the invention is therefore based on the task of further developing a shredder of the stated type according to the species such that not only an adjustment but also a cutting shaft replacement can be carried out in simple manner.

SUMMARY OF THE INVENTION

This task is solved in the shredder according to the invention wherein the fronting parts are provided such that they are divided and comprise an upper fronting part element and a lower fronting part element. In the subject matter of the invention the bearings of the at least one cutting shaft are secured in the fronting parts; these bearings are also denoted as internal bearings. Each bearing is framed by the two fronting part elements of a fronting part by being captured between the upper and lower fronting part elements thereof and thus internally of the cutting unit frame. At least the upper fronting part element of each fronting part of the cutting unit frame is detachably fastened on the adjoining side parts, wherein at the front side it adjoins the two adjoining side parts. The attachment means, employed for attaching the fronting part elements to the side parts, engage the side parts at the front side. The front side of the side parts can also be widened by a flange. The two upper fronting part elements can thus be removed, independently of the lower fronting part elements, from the cutting unit frame without having destablize it or bring it out of adjustment. The reception of the bearings between the upper and lower fronting part elements of the fronting parts also leads to the fact that already after removing the upper fronting part elements the at least one cutting shaft can be lifted readily from the cutting unit frame. The capability of removing the upper fronting part elements of the cutting unit frame also permits an especially good front-side accessibility of the cutting unit frame, in particular of the lower bearing parts, if the at least one cutting shaft is disassembled. The lower fronting part element of each fronting part remains connected with the side parts of the cutting unit frame such that it retains its adjustment or fixed condition once it is set up even when the upper fronting part element is removed.

The two opposing upper fronting part elements serve for retaining the cutting shafts with their bearings in their specified seat. For this reason it is useful to develop the fronting part elements as yoke plates, which together frame the outside of the bearing(s) of one or several cutting shafts.

For the additional attachment of the two fronting part elements with one another it can be provided that these are connected one with the other through a separate bolt connection.

BRIEF DESCRIPTION OF THE DRAWINGS

In the following the invention will be explained in conjunction with two embodiment examples with reference to the enclosed Figures. Therein depict.

DETAILED DESCRIPTION OF THE INVENTION

Figure 1:
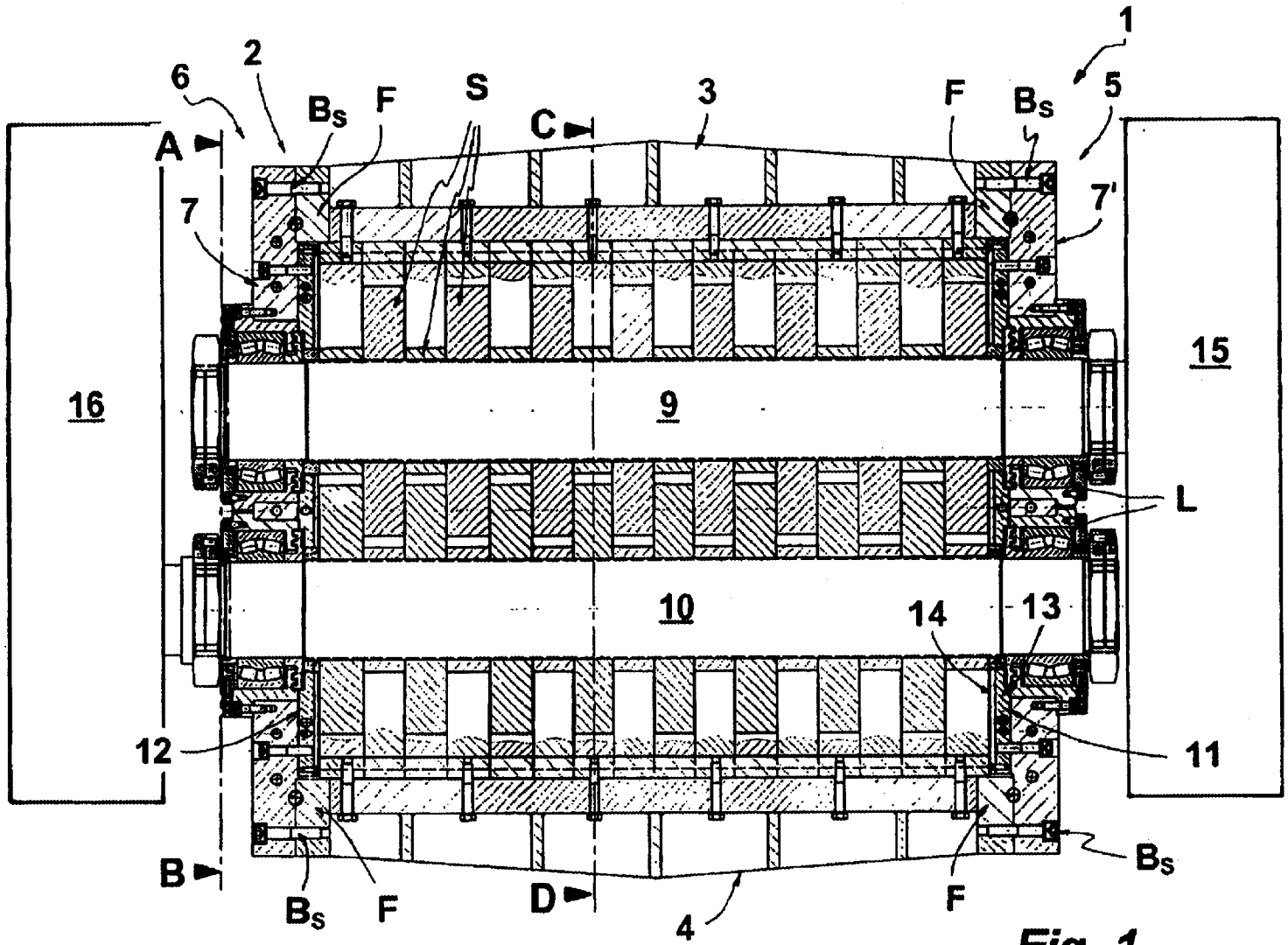
FIG. 1 a partially sectioned top view onto a shredder with two cutting shafts driven oppositely, FIG. 2 a section through the shredder of FIG. 1 along line A–B, FIG. 3 a section through the shredder of FIG. 1 along line C–D, FIG. 4 a partially sectioned side view of the shredder of FIG. 1 with the upper yoke plates dismounted, and FIG. 5 a section corresponding to that of FIG. 2 through a further shredder.

A shredder 1 comprises a cutting unit frame 2 which is comprised of two opposing side parts 3, 4 and two opposing fronting parts 5, 6 connecting the two side parts 3, 4 at the front side with one another. As is evident in the representation of FIG. 2 depicting the fronting part 6, each fronting part 5, 6 is comprised of two yoke plates 7, 8. The yoke plates 7, 8 are bolt-connected with two attachment bolts $B_j$, engaging at the top side. The yoke plates 7, 8 are bolt-connected with the side parts 3, 4 in such manner that the attachment bolts $B_S$employed for this purpose penetrate the yoke plates 7, 8 at the margin and engage attachment bores introduced at the front side into the side parts 3, 4. The attachment of the yoke plates 7, 8, and correspondingly also the dismounting of the same with, respectively from, the side parts 3, 4, consequently takes place at the front side (cf. in particular FIGS. 1 and 4 ).

The fronting parts 5, 6 serve for securing the bearings L of two cutting shafts 9, 10, which are each equipped with a multiplicity of cutting disks S. The cutting disks S of the two cutting shafts 9, 10 are disposed offset with respect to one another and with a cut gap between them measuring only a few tenths of a millimeter. The offset disposition of the cutting disks S can be seen in FIG. 1 and also FIG. 3. For framing the cutting shafts 9, 10 with their bearings L, the yoke plates 7, 8 have each two semicircular cutouts, which define a circular reception when the yoke plates 7, 8 are seated together (cf. FIG. 2).

Each fronting part 5, 6 is protected on the inside by a wear protection plate 11, 12, each of which comprises a base plate 13 and a hard steel contact plate 14. The wear protection plates 11, 12 serve for the protection of the fronting parts 5, 6 as well as also of the bearings L against damage during operation of the shredder 1.

The two cutting shafts 9, 10 are driven by driving units 15, 16 each shown schematically, wherein the driving unit 15 is provided for driving the cutting shaft 9 and the driving unit 16 for driving the cutting shaft 10.

Figure 4:
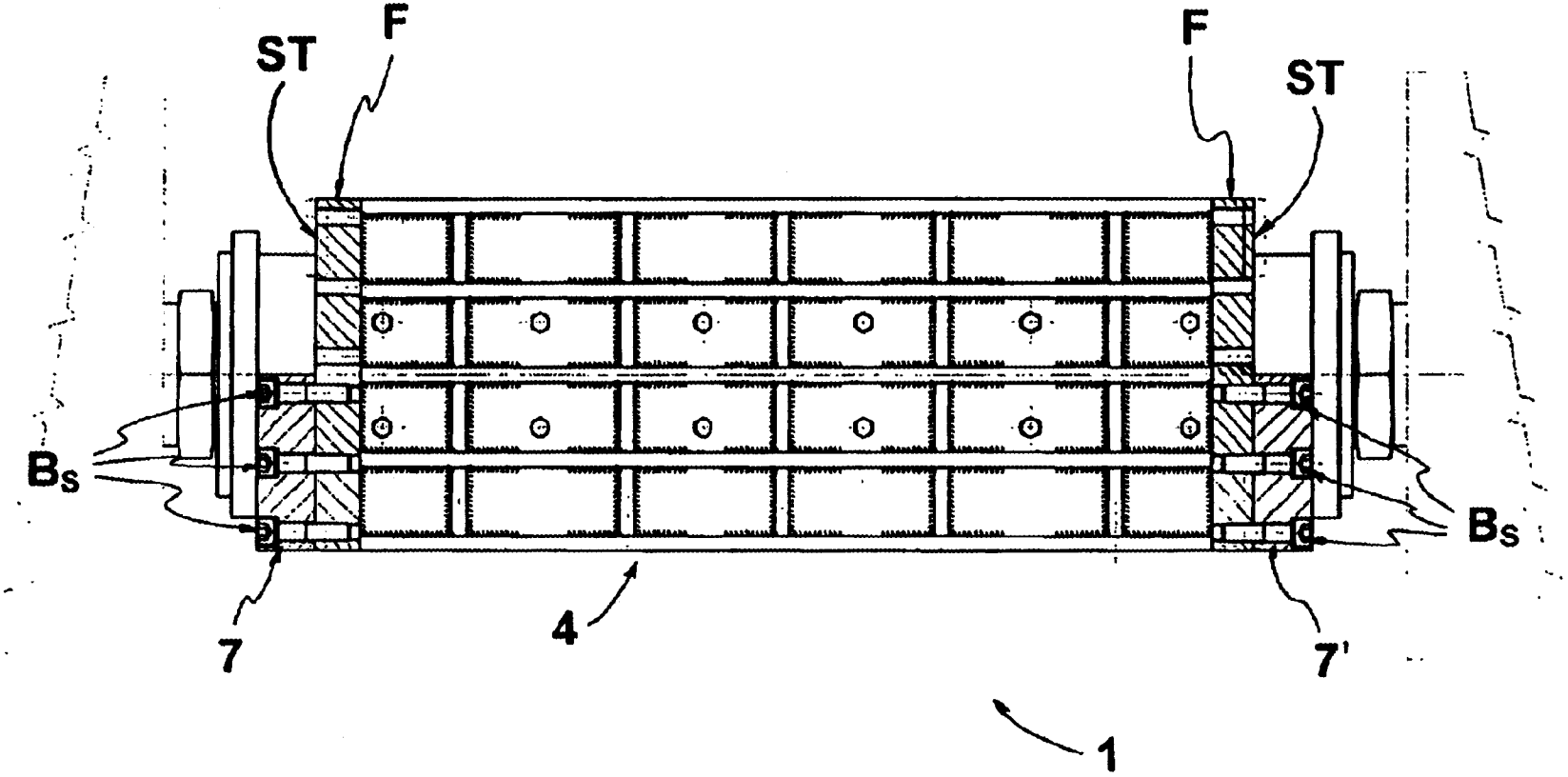

In the side view shown in FIG. 4 in the upper fronting parts elements 8 are removed, the now exposed front sides ST are evident. Further is clearly shown in this reprsentation the attachment of the lower fronting part elements 7, 7' by means of the attachment bolts $B_S$ which, in turn, engage the front sides ST of the side parts 3, 4. Correspondingly, the upper fronting part elements 8 can also be attached. The front sides ST of the side parts 3, 4 are widened through a flange, as is also evident in FIG. 1.

Figure 5:
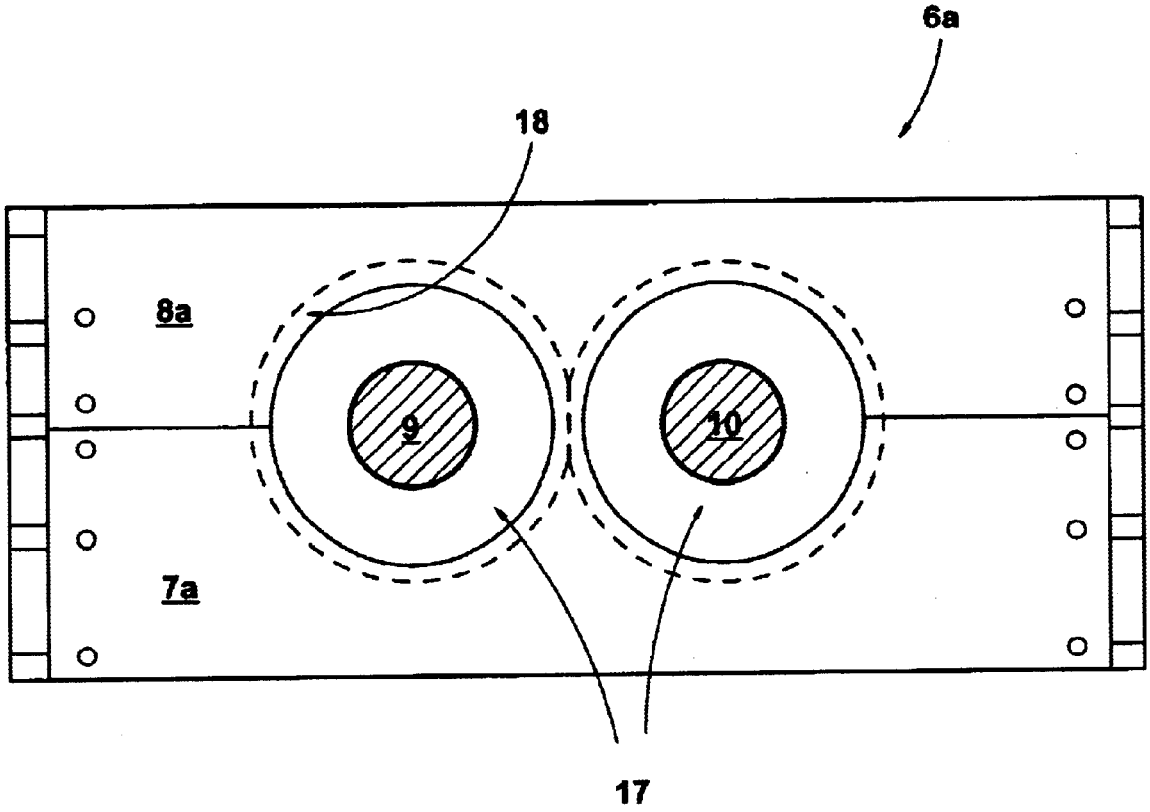

In contrast to the embodiment example of FIGS. 1 to 4, in the embodiment example shown in FIG. 5 the bearings of the cutting shafts 9, 10 are not attached through corresponding securement rings on the outside of fronting parts 5, 6. In this embodiment example the bearings are secured through clamping effect between the upper and lower fronting part elements 7*a*, 8*a* of each front part, wherein only one fronting part 6*a* is shown. For this purpose the bearing reception 17 formed by the adjoining upper and lower fronting part elements 7*a*, 8*a*, has an encircling groove 18 (shown in dashed lines in FIG. 5), which is engaged by a web projecting circumferentially from a bearing. The web of the bearings has a slight chamfer in order to support the clamping effect of the web within the encircling groove 18.

To obtain security of the bearings against torsion, they can carry a cam for the security against rotation, which engages a corresponding recess of one of the two fronting part elements 7*a*, 8*a*. A rotation security of the bearings can also be realized, for example through the implementation shown in FIG. 2, in which the two mounting rings for securing the bearings L with a severed straight side are directly adjoining.

The cutting unit frame 2 is set up during the initial operation of the shredder inter alia through corresponding bolt-connecting of the yoke plates 7, 8 or 7*a*, 8*a*, respectively, with the side parts 3, 4, and is adjusted. This setup and adjustment is retained even if the particular upper yoke plate 8 or 8*a*, respectively, of the two opposing fronting parts 5, 6 or 6*a*, respectively, is removed by unscrewing the attachment bolts $B_S$. Even with the dismounted upper yoke plates 8 or 8*a* the cutting unit frame 2 remains in its setup and adjusted disposition since through the lower yoke plates 7, 7' or 7*a*, respectively, in contrast to the prior known prior art, the cutting unit frame 2 is overall not changed in this respect.

The cutting unit frame 2 consequently does not need to be newly set up or adjusted after renewed mounting of the two upper yoke plates 8 or 8*a*.

Based on the description of the invention, it is evident that a cutting shaft replacement in the shredder according to the invention, due to the front-side attachment of the upper yoke plates, can be carried out without any degradation of the adjustment of the cutting unit frame and that for this reason the changing time is reduced to only that time which is required for replacing the cutting shafts. In particular in the case of shredders, which are employed in continuous operation, this time saving, due to the saving of a renewed adjustment of the cutting unit frame, leads to considerable advantages.

| Compilation of Reference Symbols | |
|---|---|
| 1 | Shredder |
| 2 | Cutting unit frame |
| 3 | Side part |
| 4 | Side part |
| 5 | Fronting part |
| 6 | Fronting part |
| 7, 7' | Yoke plate |
| 8 | Yoke plate |
| 9 | Cutting shaft |
| 10 | Cutting shaft |
| 11 | Wear protection plate |
| 12 | Wear protection plate |
| 13 | Base plate |
| 14 | Hard steel contact plate |
| 15 | Driving unit |
| 16 | Driving unit |
| 17 | Bearing reception |
| 18 | Groove |
| $B_J$ | Attachment bolt |
| $B_S$ | Attachment bolt |
| F | Flange |
| S | Cutting disk |
| ST | Front side |
| L | Bearing |

What is claimed is:

1. A shredder, comprising:

(a) at least one cutting shaft having a pair of opposite ends;

(b) a multiplicity of cutting disks supported by and rotatable with said at least one cutting shaft for shredding an item in cooperation with a further tool; and (c) a cutting unit frame having two opposing side parts and two fronting parts, each of said two side parts spaced apart and extending generally parallel to one another and to said at least one shaft and terminating in a pair of oppositely facing front sides, each of said fronting parts spaced apart and extending transversely to said opposing side parts and said at least one shaft and between said opposing side parts and crossing said opposite ends of said shaft such that said two fronting parts and two opposing side parts together surround said cutting disks supported on said at least one shaft, each of said fronting parts having upper and lower fronting part elements detachably attached to one another and separately of one another being attached at opposite ends of said upper and lower fronting part elements to said opposing side parts at said oppositely facing front sides thereof such that said cutting unit frame is thereby assembled in a fixed condition surrounding said cutting disks, at least said upper fronting part elements of said fronting parts being detachably attached at said opposite ends thereof to said opposing side parts; and (d) a pair of annular bearings each disposed over and extending about one of said opposite ends of said at least one shaft and being captured between said upper and lower fronting part elements of one of said fronting parts such that bearings are disposed and supported internally of said cutting unit frame and, in turn, rotatably support said opposite ends of said at least one shaft in said fronting parts of said cutting unit frame and are removable with said at least one shaft from said cutting unit frame upon detaching only said upper fronting part elements of said fronting parts from said opposing side parts and from said lower fronting part elements of said fronting parts without detaching said lower fronting part elements of said fronting parts from said opposing side parts of said cutting unit frame and thereby without placing said cutting unit frame out of said fixed condition.

2. Shredder as recited in claim 1 wherein said upper and lower fronting part elements of said fronting parts are yoke plates having semicircular cutouts receiving said bearings.

3. Shredder as recited in claim 1 wherein said upper fronting part element of each of said fronting parts is detachably bolted to adjoining side parts.

4. Shredder as recited in claim 1 wherein said lower fronting part element of each of said fronting parts is detachably bolted to said adjoining side parts.

5. Shredder as a recited in claim 1 wherein said upper fronting part element of each of said fronting parts is detachably bolted to said lower fronting part element thereof.

6. Shredder as recited in claim 1 wherein said bearings of said at least one cutting shaft are fixed between said upper and lower fronting part elements of said fronting parts by a clamping therebetween.

7. Shredder as recited in claim 1 wherein on said fronting part elements of each of said fronting parts on sides of said fronting parts facing toward said cutting disks on said at least one cutting shaft are attached wear protection plates each having a base plate and a hard steel contact plate disposed in front of said base plate.

* * * * *